US007500437B2

(12) United States Patent
Lefebvre et al.

(10) Patent No.: US 7,500,437 B2
(45) Date of Patent: Mar. 10, 2009

(54) METHOD AND SYSTEM FOR SCR OPTIMIZATION

(75) Inventors: Wesley Curt Lefebvre, Boston, MA (US); Daniel W. Kohn, Cambridge, MA (US)

(73) Assignee: NeuCo, Inc., Boston, MA (US)

( * ) Notice: Subject to any disclaimer, the term of this patent is extended or adjusted under 35 U.S.C. 154(b) by 0 days.

(21) Appl. No.: 11/012,630

(22) Filed: Dec. 15, 2004

(65) Prior Publication Data

US 2006/0042525 A1 Mar. 2, 2006

Related U.S. Application Data

(60) Provisional application No. 60/604,921, filed on Aug. 27, 2004.

(51) Int. Cl.
*F23N 5/18* (2006.01)

(52) U.S. Cl. ..... 110/186; 110/188

(58) Field of Classification Search ..... 110/185–191, 110/341–345

See application file for complete search history.

(56) References Cited

U.S. PATENT DOCUMENTS

| | | | | |
|---|---|---|---|---|
| 4,839,148 | A * | 6/1989 | Ritter et al. | 423/239.1 |
| 4,965,742 | A | 10/1990 | Skeirik | |
| 4,985,824 | A | 1/1991 | Husseiny et al. | |
| 5,167,009 | A | 11/1992 | Skeirik | |
| 5,212,765 | A | 5/1993 | Skeirik | |
| 5,224,203 | A | 6/1993 | Skeirik | |

(Continued)

OTHER PUBLICATIONS

Boyden, S., Black, S. and Piche, S., Stoverlooked Opportunity: Advanced Pmcess Control for Air Pollution Control Devicesy Electric Utilities Environmental Conference, Tucson, AZ, Jan. 20-22, 2004.*

(Continued)

*Primary Examiner*—Kenneth B Rinehart
(74) *Attorney, Agent, or Firm*—Kusner & Jaffe

(57) ABSTRACT

Methods and systems are provided for controlling SCR performance in a boiler. The boiler includes one or more generally cross sectional areas. Each cross sectional area can be characterized by one or more profiles of one or more conditions affecting SCR performance and be associated with one or more adjustable desired profiles of the one or more conditions during the operation of the boiler. The performance of the boiler can be characterized by boiler performance parameters. A system in accordance with one or more embodiments of the invention can include a controller input for receiving a performance goal for the boiler corresponding to at least one of the boiler performance parameters and for receiving data values corresponding to boiler control variables and to the boiler performance parameters. The boiler control variables include one or more current profiles of the one or more conditions. The system also includes a system model that relates one or more profiles of the one or more conditions in the boiler to the boiler performance parameters. The system also includes an indirect controller that determines one or more desired profiles of the one or more conditions to satisfy the performance goal for the boiler. The indirect controller uses the system model, the received data values and the received performance goal to determine the one or more desired profiles of the one or more conditions. The system model also includes a controller output that outputs the one or more desired profiles of the one or more conditions.

4 Claims, 5 Drawing Sheets

U.S. PATENT DOCUMENTS 5,237,939 A * 8/1993 Spokoyny et al. ..... 110/345
5,282,261 A 1/1994 Skeirik
5,386,373 A 1/1995 Keeler
5,471,381 A 11/1995 Khan
5,493,631 A 2/1996 Huang et al.
5,543,116 A * 8/1996 Bernstein et al. ..... 422/111
5,704,011 A 12/1997 Hansen
5,781,432 A 7/1998 Keeler
5,822,740 A 10/1998 Haissig
6,002,839 A 12/1999 Keeler
6,063,292 A 5/2000 Leung
6,241,435 B1 6/2001 Huang et al.
6,325,025 B1 12/2001 Perrone
6,381,504 B1 * 4/2002 Havener et al. ..... 700/44
6,423,696 B1 7/2002 Collins
6,425,352 B2 7/2002 Perrone
6,532,454 B1 3/2003 Werbos
6,571,420 B1 * 6/2003 Healy et al. ..... 15/301
6,583,964 B1 6/2003 Huang et al.
6,668,201 B1 12/2003 Bonissone et al.
6,721,606 B1 4/2004 Kaji et al.
6,725,208 B1 4/2004 Hartman
6,736,089 B1 * 5/2004 Lefebvre et al. ..... 122/379
6,757,579 B1 6/2004 Pasadyn
6,823,675 B2 11/2004 Brunell et al.
7,166,262 B2 * 1/2007 Buzanowski ..... 423/239.1
2003/0195641 A1 10/2003 Wojsznis et al.
2004/0170441 A1 9/2004 Forbes et al.
2004/0191912 A1 * 9/2004 Bade et al. ..... 435/468
2006/0042461 A1 * 3/2006 Boyden et al. ..... 95/1
2006/0045800 A1 * 3/2006 Boyden et al. ..... 422/62
2006/0045801 A1 * 3/2006 Boyden et al. ..... 422/62
2006/0047526 A1 * 3/2006 Boyden et al. ..... 705/1
2006/0047607 A1 * 3/2006 Boyden et al. ..... 705/400

OTHER PUBLICATIONS

Boyden, S., Piche, S. and Czarnecki, L., EûAdvanced SCR Control for Dynamic Ammonia Distributiony Conference on Selective Catalytic Reduction and Non-catalytic Reduction for Nox Control, Pittsburgh, PA, Oct. 30, 2003.*
Smith, S., Zablocky, P., Kohn, D., and Noble, G., Sscombustion Optimization Case Studies and Emerging Applications, Combined Power Plant Air Pollutant Control Mega Symposium, May 19, 2003.*
Sarunac, N., et al., "Sootblowing Optimization Helps Reduce Emissions from Coal-Fired Utility Boilders," Energy Research Center, Lehigh University, Bethlehem, PA.
Nakoneczny, G., et al., "Implementing B&W's Intelligent Sootblowing System at MidAmerican Energy Company's Louisa Energy Center Unit 1," Western Fuels Conference, Aug. 12-13, 2002, Albuquerque, NM.
Stallings, J., Fifth Intelligent Sootblowing Workshop, Electric Power Research Institute, Jun. 2004, Palo Alto, CA.
Rhode, M., et al., "Tampa Electric's Neutral Network Based Intelligent Sootblowing," 4th Intelligent Sootblowing Workshop, Mar. 19-21, 2002.
Anonymous, "Intelligent Sootblowing Demonstration at Texas Glenco's W.A. Parish Plant," Electric Power Research Institute, Dec. 2003.
Anonymous, "Intelligent Sootblowing at TVA's Bull Run Plant," Electric Power Research Institute, Dec. 2003.
Shinskey, F.G., "Controlling Multivariable Processes", Instrument Society of America, 1981.
Shinskey, F.G., "Process Control Systems", McGraw-Hill, 1979.
Piche, et al., "Nonlinear Model Predictive Control Using Neural Network," IEEE Control Systems, pp. 53-62, Jun. 2000.
Hesnon, M. and Seborg, D., "Nonlineary Model Predictive Control," Prentice Hall, 1997.
Chen et al., "Nonlineary Neural Network Internal Model Control with Fuzzy Adjustable Parameter", IEEE International conference on Industrial Technology, 1996.
Lin et al., "Hybrid Adaptive Fuzzy Control Wing Rock Motion System and H Robust Performance", IEEE International conference on Industrial Technology, 2003.

* cited by examiner

METHOD AND SYSTEM FOR SCR OPTIMIZATION

RELATED APPLICATION

This application is based on and claims priority from U.S. Provisional Patent Application Ser. No. 60/604,921 filed Aug. 27, 2004 and entitled Methods and Systems for SCR Optimization, the specification of which is incorporated by referenced herein in its entirety.

GOVERNMENT RIGHTS

This invention was made with Government support under Contract Number DE-FC26-04NT41768 awarded by the U.S. Department of Energy. The Government has certain rights in the invention.

FIELD OF THE INVENTION

The present application relates generally to fossil fuel boilers and, more particularly, to optimizing Selective Catalytic Reduction (SCR) performance in fossil fuel boilers.

BACKGROUND OF THE INVENTION

The combustion of coal and other fossil fuels during the production of steam or power produces dozens of gaseous oxides, such as NO, $NO_2$, $N_2O$, $H_2O$, HO, $O_2H$, CO, $CO_2$, SO, $SO_2$, etc. which together, with $N_2$ and excess $O_2$, make up the overwhelming majority of the boiler flue gas. Many of these species, such as OH and $O_2H$ are highly reactive and are chemically quenched prior to the flue gas exit from the boiler stack. Some of the species, such as CO, $CO_2$, and $H_2O$ are highly stable, the vast majority of which will pass unreacted out of the boiler stack. Still other species, such as $SO_2$, NO, and $NO_2$ are moderately reactive. These moderately reactive species are subject to removal from the flue gas by chemical reaction processes, and are also subject to complex variability.

NO and $NO_2$, together referred to as NOx, are gases that are highly toxic to humans. NOx can combine with $H_2O$ to form nitric acid in the lungs and other mucosal membranes. In addition, NOx can react with $O_2$ in the lower troposphere to form ozone, also a toxic gas. For these and other reasons, including federal and state legislation, many industrial power plants need to find ways to cost effectively reduce the flue gas NOx to acceptable emission levels.

NOx levels out of the furnace of industrial coal burning power plants vary, depending upon the particular combustion technology, typically from about 100 parts per million (ppm) to greater than one thousand ppm. NOx levels out of the furnace of industrial oil and gas burning power plants vary less, because of the consistency of the fuel sources, from about 100 ppm to 600 ppm. Oil and gas combustion tend to produce lower levels of NOx than does coal combustion because there is little nitrogen found within oil or gas, and because they tend to burn at lower temperature than coal due to their relatively simple molecular structures. Desirable emission levels vary, depending upon many factors including plant location, stack height, furnace NOx levels, and state laws and provisions. Desirable emission levels may be expressed as an absolute number, e.g. less than 50 ppm, or as a percentage reduction from the furnace NOx levels. Desirable NOx emission levels can be as low as 10 ppm.

A number of technologies have been adapted by industrial power plants in order to reduce furnace NOx levels to acceptable emission levels. These include SCR, Selective NonCatalytic Reduction (SNCR), boiler optimization and tuning, the use of Over Fire Air (OFA) and other vertical staging of furnace air introduction techniques, and the use of low NOx burners. Each method has a typical NOx reduction range that tends to correlate well with the cost the market will bear for the device. Of the methods listed, the SCR is capable of removing the greatest quantities of NOx from the flue gas but does so at a very high cost. Design and installation costs for industrial SCRs run into hundreds of millions of U.S. dollars. Annual operational costs, including reducing reagent, maintenance, and catalyst replacement, for an industrial SCR can run into the millions of dollars.

An SCR works by adding a reactive chemical reducing agent into the flue gas in appropriate stoichiometric amounts so that it may react with the NOx molecules and undergo a chemical reaction into harmless byproducts. A catalyst, typically a solid phase metal oxide deposited on a support structure, is used to accelerate the rate of key steps in the chemical reactions. Typically, a catalyst will drop the energy of activation for a reaction by transiently binding with one or more of the reagents. One of the most commonly used catalysts found in SCR is di-Vanadium Pentoxide ($V_2O_5$). In addition to the active catalytic molecule, SCRs may contain molecules whose purpose is to impact other important reactions, such as impeding the catalyst poisoning from Na, K, $AsO_3$, Pb, P, Cl, F, etc. The additives vary between vendors and differ according to the SCR design, fuel being burned, and other factors.

Nearly all SCRs use ammonia ($NH_3$) as the reducing reagent. Though there are many reactions that may be used to reduce NOx into harmless byproducts, one of the more common is $$NH_3+NO+\tfrac{1}{4}O_2 \rightarrow 1\tfrac{1}{2}H_2O+N_2$$

indicating that ammonia and NO combine in a one to one ratio, and with oxygen in a 4 to 1 ratio, to produce water and nitrogen gas. This and other reaction mechanisms indicate the actual stoichiometric ratio of NOx and reducing reagent that get consumed by the reaction. If the actual flue gas contains an excess of either ammonia or NOx, that excess will leave the SCR, where it can subsequently react or remain in the flue gas until it exits at the stack. Excess ammonia is considered undesirable because it can render trapped fly-ash unsellable due to odor and because it is a very toxic and corrosive gas that should not exit the stack in even small amounts. Excess NOx is considered undesirable because this indicates that the SCR was not operating at its full potential efficiency. Excess NOx or ammonia are referred to as "slip".

SCR manufacturers have developed numerous methods and devices in an attempt to achieve the tightest stoichiometric matching of injected reducing reagent to furnace NOx, and thereby achieving the highest effectiveness and efficiency of SCR performance. There are several challenges to matching the stoichiometry of the reagent and the NOx.

One challenge to SCR optimization is to adjust the ammonia injection to the continuously varying distribution of NOx that comes out of the furnace. Levels of NOx can vary by a factor of two or more as measured laterally, front to back or left to right, across the duct. The variations can happen rapidly and are a function of both exogenous (outside of the immediate operator or automatic control) and endogenous factors. Factors include load, temperature, coal type, unit load, burner tilts, lateral fuel biases, lateral air biases, LOI, turbulence, coal particle size, vertical fuel bias, and vertical air bias, including OFA.

Rather than grapple with the problem of constantly matching the reagent injection profile to the NOx profile at all points along the two dimensions of lateral traversal across the duct, some SCR designs rely on the use of mixers to generally remove all lateral variations in the boiler NOx profile. Ammonia may then be injected into the mixed flue gas and the combined gases then mixed again, to attempt to ensure the equal distribution of the ammonia. This method has a thermodynamic efficiency cost related to the loss of exergy from the mixing process. The greater the mixing, the greater the thermodynamic efficiency cost. The effectiveness and corresponding design of mixing devices is dependent in part on the flue gas velocity. Since the mixing devices typically are static structures, they are, by design, only optimized for mixing at the design load. As a result, the mixing efficiency will be sub-optimal at various, off-design, times of operation. Areas with less than perfect mixing will result in poor stoichiometry and associated slip of either NOx or ammonia.

Another way to manage the variability of the NOx distribution is to enable the automated and real time manipulation of the reagent injection profile so that it can be adjusted to match the NOx distribution. A drawback to this method is that it requires the manipulation of multiple valves in the ammonia injection grid (AIG). There is an installation expense to configuring multiple valves for actuation, an operational expense to enabling the real time manipulation of multiple AIG valves, and a complication and associated hazard of adding any movable part into an ammonia system. At present, very few SCRs in the U.S. are designed with this degree of on line control built into the AIG.

Another way to manage the variability of the NOx distribution is to enable the manipulation of the reagent injection profile on a non-real time, periodic basis. Most SCRs in the U.S. use this method, first tuning the AIG profile at commissioning of the SCR and then again on an annual basis. The tuning procedure includes identification of the typical NOx distribution patterns from the boiler and subsequent adjustment of the AIG valves to achieve the desired stoichiometry. The AIG valves are then fixed in this position until the next study is performed. There are numerous drawbacks to this methodology. First, the tuning is optimized for the typical, modal (design) load factors of the boiler. At off-design loads the NOx distribution will change and will result in additional NOx slip or ammonia slip. Another drawback to this method is that it cannot compensate for the slow drifts that occur in the NOx distribution at the modal (and other) load over the period of a year. Another drawback to this method is that it cannot compensate for the variations that occur in furnace NOx distribution that result from different operator or automatic controllers that manipulate burner tilts, lateral fuel biases, lateral air biases, LOI, turbulence, coal particle size, vertical fuel bias, and vertical air bias, including OFA. In effect, this method is optimized for operation at the modal NOx distribution of the furnace and is sub-optimal at all other conditions, resulting in additional NOx slip or ammonia slip.

The lateral furnace NOx profile can change as a function of air and fuel introduction parameters because NOx is created largely out of the Oxygen found in the air and Nitrogen found in the fuel. However, NOx profiles and, more importantly, integrated NOx quantities are strongly dependent upon the combustion temperature of the furnace and therefore upon the load of the unit. The very strong temperature dependence of NOx formation is a result of the usually exponential dependence of chemical reaction rates on temperature.

As a result, another challenge to SCR optimization is to adjust the net ammonia injection amount into the flue gas as a function of combustion temperature. Because combustion temperature is expensive to measure continuously and reliably, most SCRs do not use it as the input parameter for injected ammonia, but rather use unit load, a good proxy for combustion temperature, as the input parameter. Typically, design curves are used to represent the total furnace NOx production as a function of unit load. The load based NOx design curves are typically created during the commissioning of the SCR and may be updated periodically over the life of the SCR. The load based NOx curves are typically used by the DCS or other automated control system for the feed forward control of the total amount of injected ammonia. In particular, as unit load goes up, the feed forward control will anticipate the increased production of furnace NOx and will adjust the total ammonia injection levels accordingly. One drawback to feed forward control is that it does not make adjustments to the injected ammonia as a function of any variable except that which is specified in the curve. So, for instance, a large change in furnace NOx production resulting from a change in coal type would not result in a change in total ammonia injection. For this reason, most SCR control systems that deploy a feed forward control loop also deploy a feed back control loop.

The feedback control loop of the SCR is typically designed to measure the NOx slip (NOx level in the stack) and adjust the feed forward specified ammonia injection amount so as to maintain a constant NOx slip or percentage NOx removal. The feedback loop can therefore correct for variations of total furnace NOx productions that differ from the load based design curves.

Another challenge to SCR optimization is to make accommodations for the fact that the catalyst will degrade and will degrade non-isotropically. Non-isotropic degradation of the catalyst leads to certain flow lines through the catalyst bed having greater or lesser integrated activity than the average. As the average integrated activity drops, those flow lines of lesser activity than average can eventually reach a critical level where complete reaction of the NOx and the ammonia no longer occurs, resulting in both NOx and ammonia slip along those flow lines. This situation is particularly difficult to manage because the standard SCR feedback loops will see an increase in NOx slip and will correct for it by increasing the injected ammonia, which will have the unintended affect of increasing ammonia slip.

The catalyst degradation itself can be due to a number of factors. These factors include high flue gas temperatures (which lead to a phase transition of the catalyst); plugging of the catalyst pores and masking of the catalyst surface (with Calcium and Ammonium sulfate salts or with fly ash); and poisoning of the active catalytic sites (with Na, K, $AsO_3$, Pb, P, Cl, F, etc.).

Non-isotropic catalyst degradation can result from a number of sources. One source is the maldistribution of furnace gases resulting from poorly balanced combustion conditions. Since the flue gas in most industrial power plants is subject to laminar flow conditions, maldistributions at the furnace can manifest in the SCR. Another related source of non-isotropic degradation are temperature spikes along certain flow lines resulting from non-isotropic cleaning of the heat transfer surfaces in the back pass. Another source of non-isotropic degradation is from high levels of ammonia injections in parts of the AIG that lead to enhanced ammonium sulfate condensation in the SCR. Yet another source of non-isotropic degradation is from systematic errors in sootblowing of the catalyst bed.

The overall activity level of the catalyst bed can be defined as a number between 1 and 0, where 1 indicates a completely active, usually fresh and clean, surface and where 0 indicates no active surface remaining. Recommendations vary according to manufacturer, but catalyst beds are typically changed out when the activity drops to anywhere between 0.5 and 0.9. Since changing the catalyst is a very expensive proposition, extending the usable life of the catalyst is desirable. Regardless of the activity level of the catalyst, catalyst change or addition is usually required when ammonia slip levels exceed a certain design specification, which is usually in the range of 2-5 ppm.

Industrial SCRs are built with an excess of catalyst. If the challenges to SCR control described above could be resolved, these SCRs could operate at 100% NOx removal efficiency with negligible ammonia slip. Instead, most SCRs operate at about 80-90% removal efficiency. Enhanced control of these challenges is therefore desirable.

BRIEF SUMMARY OF PREFERRED EMBODIMENTS OF THE INVENTION

In accordance with one or more embodiments of the invention, a system is provided for controlling SCR performance in a boiler. The boiler includes one or more generally cross sectional areas. Each cross sectional area can be characterized by one or more profiles of one or more conditions affecting SCR performance and be associated with one or more adjustable desired profiles of the one or more conditions during the operation of the boiler. The performance of the boiler can be characterized by boiler performance parameters. A system in accordance with one or more embodiments of the invention can include a controller input for receiving a performance goal for the boiler corresponding to at least one of the boiler performance parameters and for receiving data values corresponding to boiler control variables and to the boiler performance parameters. The boiler control variables include one or more current profiles of the one or more conditions. The system also includes a system model that relates one or more profiles of the one or more conditions in the boiler to the boiler performance parameters. The system also includes an indirect controller that determines one or more desired profiles of the one or more conditions to satisfy the performance goal for the boiler. The indirect controller uses the system model, the received data values and the received performance goal to determine the one or more desired profiles of the one or more conditions. The system model also includes a controller output that outputs the one or more desired profiles of the one or more conditions.

In accordance with one or more embodiments of the invention, a system is provided for determining one or more desired operating settings for one or more devices affecting SCR performance in a fossil fuel boiler. The operation of the one or more devices can be characterized by adjustable operating settings. The performance of the boiler can be characterized by boiler performance parameters. The system includes a controller input for receiving a performance goal for the boiler corresponding to at least one of the boiler performance parameters and for receiving data values corresponding to boiler control variables and to the boiler performance parameters. The system also includes a system model that relates operating settings for the one or more devices to the boiler performance parameters. The system also includes an indirect controller that determines one or more desired operating settings for the one or more devices to satisfy the received performance goal for the boiler using the system model, and using the received performance goal for the boiler and the received data values. The system also includes a controller output that outputs the one or more desired operating settings for the one or more devices.

In accordance with one or more embodiments of the invention, a system is provided for determining one or more desired profiles of one or more conditions affecting SCR performance in a boiler. The boiler has one or more generally cross sectional areas, each being characterized by one or more profiles of the one or more conditions and being associated with one or more adjustable desired profiles of the one or more conditions during the operation of the boiler. The performance of the boiler can be characterized by boiler performance parameters. The system includes a controller input for receiving a performance goal for the boiler corresponding to at least one of the boiler performance parameters and for receiving data values corresponding to boiler control variables and to the boiler performance parameters. The boiler control variables include one or more current profiles of the one or more conditions. The system also includes a direct controller that determines one or more desired profiles of the one or more conditions to satisfy the performance goal for the boiler. The direct controller uses the received data values and the received performance goal to determine the one or more desired profiles of the one or more conditions. The system also includes a controller output that outputs the one or more desired profiles of the one or more conditions.

In accordance with one or more embodiments of the invention, a system is provided for determining one or more desired operating settings for one or more devices affecting SCR performance in a fossil fuel boiler. The operation of the one or more devices can be characterized by adjustable operating settings. The performance of the boiler can be characterized by boiler performance parameters. The system includes a controller input for receiving a performance goal for the boiler corresponding to at least one of the boiler performance parameters and for receiving data values corresponding to boiler control variables and to the boiler performance parameters. The system also includes a direct controller that determines one or more desired operating settings for the one or more devices to satisfy the received performance goal for the boiler using the received performance goal for the boiler and the received data values. The system also includes a controller output that outputs the one or more desired operating settings for the one or more devices.

In accordance with one or more embodiments of the invention, a system is provided for controlling SCR performance in a fossil fuel boiler. The boiler includes one or more generally cross-sectional areas, each cross-sectional area defining a profile of a condition at the cross-sectional area. The system includes one or more devices associated with the one or more cross-sectional areas for adjusting the profile at a cross-sectional area. The one or more devices operate in accordance with adjustable operating parameters. The system also includes one or more sensors associated with the one or more cross-sectional areas for detecting conditions at the one or more cross-sectional areas. The system also includes an indirect controller that determines operating settings for the one or more devices. The indirect controller includes a system model that relates operating settings for the one or more devices to desired profiles of the conditions. The indirect controller has a controller input in communication with the one or more sensors. The indirect controller uses the conditions detected by the one or more sensors, the system model, and the desired profiles to determine operating settings for the one or more devices. The indirect controller further includes a controller output in communication with the one or more devices to transmit the operating settings to the one or more devices.

In accordance with one or more embodiments of the invention, a method is provided for determining one or more desired profiles of one or more conditions in a boiler. The boiler has one or more generally cross-sectional areas, each cross-sectional area being characterized by a profile of a condition and being associated with a desired profile of the condition during the operation of the boiler. The performance of the boiler can be characterized by one or more boiler performance parameters. The method includes the steps of: (a) implementing a controller with a system model that relates the one or more profiles in the boiler to the performance of the boiler; (b) obtaining a performance goal for the boiler; (c) receiving data corresponding to the boiler performance parameters and boiler control variables; (d) determining an operating point corresponding to the performance goal using the system model; (e) determining one or more desired profiles associated with the operating point using the system model; and (f) communicating the one or more desired profiles to one or more subsystems operable to adjust one or more profiles.

In accordance with one or more embodiments of the invention, a method is provided for determining desired operating settings for one or more devices affecting SCR performance in a boiler. The operation of the one or more devices can be characterized by one or more operating parameters. The performance of the boiler can be characterized by one or more boiler performance parameters. The method can include the steps of: (a) implementing a controller with a system model that relates the operating parameters of the one or more to the boiler performance parameters; (b) obtaining a performance goal for the boiler; (c) receiving data corresponding to the boiler performance parameters and boiler control variables; (d) determining an operating point corresponding to the performance goal using the system model; (e) determining operating settings of the one or more devices associated with the operating point using the system model; (f) determining a control move using the operating settings determined in step (e) for directing the boiler to the operating point; and (g) communicating the control move to the one or more devices to adjust operating parameters of the one or more devices.

In accordance with one or more embodiments of the invention, a method is provided for controlling one or more profiles of conditions in a boiler. The boiler has one or more generally cross-sectional areas, each having a profile of a condition and is associated with a desired profile during the operation of the boiler. The performance of the boiler can be characterized by boiler performance parameters. The method can include the steps of: (a) providing a direct controller that determines one or more desired profiles in relation to a boiler performance goal; (b) obtaining a performance goal for the boiler; (c) determining whether the performance goal is satisfied by current boiler performance; (d) when the performance goal is not satisfied, identifying the generally closest operating region in which the performance goal would be satisfied, the operating region being associated with one or more desired profiles; and (e) outputting the one or more desired profiles.

In accordance with one or more embodiments of the invention, a method is provided for adjusting operating settings of one or more devices affecting SCR performance in a boiler. The boiler has one or more generally cross-sectional areas. Each of the one or more devices is associated with a cross-sectional area. Each cross-sectional area has a profile of a condition and is associated with a desired profile. The performance of the boiler is characterized by boiler performance parameters. The method can include the steps of: (a) providing a direct controller that determines desired operating settings of the one or more devices in relation to a performance goal for the boiler; (b) obtaining a performance goal for the boiler; (c) determining whether the performance goal is satisfied by current boiler performance; (d) when the performance goal is not satisfied, identifying the generally closest operating region in which the performance goal would be satisfied using the direct controller, the operating region being associated with desired operating parameters of the one or more devices; (e) determining a control move using the desired operating parameters of the one or more devices for directing the boiler to the operating region; and (f) communicating the control move to the one or more devices.

In accordance with one or more embodiments of the invention, a method is provided for adjusting operating settings for one or more devices affecting one or more profiles of conditions affecting SCR performance in a boiler. The boiler includes one or more generally cross-sectional areas. Each of the one or more devices is associated with a cross-sectional area. Each cross-sectional area has a profile of a condition. The method can include the steps of: (a) providing an indirect controller with a system model that relates the operating settings of the one or more devices to respective profiles; (b) providing data values to the indirect controller indicative of actual profiles; (c) providing one or more desired profiles to the indirect controller; (d) determining desired operating settings for the one or more devices, to attain the desired respective profiles using the indirect controller; (e) determining a control move derived from the desired operating settings; and (f) communicating the control move to the one or more devices.

These and other features and advantages of the present invention will become readily apparent from the following detailed description, wherein embodiments of the invention are shown and described by way of illustration of the best mode of the invention. As will be realized, the invention is capable of other and different embodiments and its several details may be capable of modifications in various respects, all without departing from the invention. Accordingly, the drawings and description are to be regarded as illustrative in nature and not in a restrictive or limiting sense, with the scope of the application being indicated in the claims.

BRIEF DESCRIPTION OF THE DRAWINGS

In the drawings, like reference numbers are used to generally denote like parts.

DETAILED DESCRIPTION OF THE PREFERRED EMBODIMENTS

The terms "optimal," "optimize," and "optimization" and the like as used herein refer to generally to improving (e.g., efficiency, effectiveness or performance) and are not intended to require attaining ideal performance or any particular best value.

Figure 1:
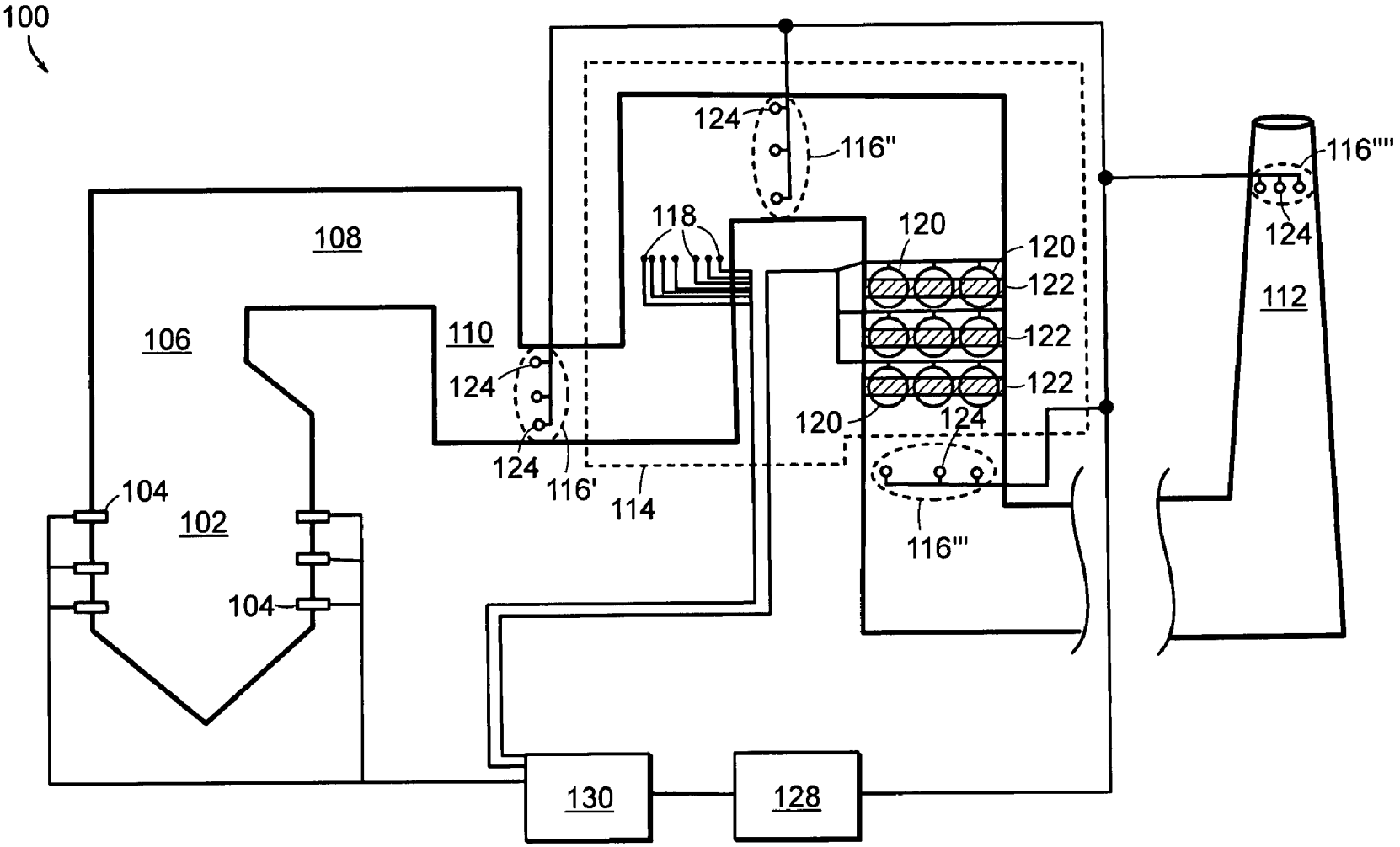
FIG. 1 is a schematic diagram of a fossil fuel boiler with an SCR optimization system in accordance with one or more embodiments of the invention.

FIG. 1 schematically illustrates an exemplary fossil fuel boiler 100. The fossil fuel boiler 100 includes a combustion zone or furnace 102 for the combustion of fuel with air. The furnace 102 includes mechanisms and arrangements for the introduction of the fuel and air. These mechanisms can vary widely, and are indicated here generally by the fuel and air inlet mechanisms 104. The furnace 102 leads to a first constriction 106 in the boiler 100. Beyond the construction 106 is a backpass 108, which is shown in FIG. 1 by a horizontal section and, proceeding from left to right, leading to a first descending section 110. The furnace and the backpass both contain heat transfer elements, such as metal tubing, containing heat transfer fluids that absorb radiant and convective heat from the hot combustion and post-combustion gases and circulates that heat to where it may be used to do work, such as turning a turbine. The circulation of those workable fluids and the resulting production of mechanical and electrical work is well known and commonly referred to as the steam cycle and is not illustrated in FIG. 1. After leaving the backpass 108, the flue gas proceeds through the boiler ductwork towards a stack 112, which releases the flue gas into the atmosphere. Emissions control related devices, such as SCR, Flue Gas Desulfurization (FGD), ElectroStatic Precipitator (ESP), or other devices can be located between the backpass 108 and the stack 112. In some boiler designs, emission control devices may also be located in the furnace or the backpass. Selective Non-Catalytic Reduction devices, SNCR, can be located in the backpass and take advantage of the high temperatures present in that area.

As illustrated in FIG. 1, in order to optimize the efficiency and effectiveness of an SCR (generally indicated by reference number 114), the fossil fuel boiler 100 may be divided into one or more generally cross-sectional slices or areas 116 (116', 116", 116''', 116''''), each of which can separately be monitored for one or more of NOx, ammonia, and catalyst activity. In order to optimize the system for the removal of NOx, the generally least generation of $NH_3$ slip, and the generally most cost effective use of catalyst, any one of the cross sectional slices 116 can be associated with one or more of desirable NOx, ammonia, and catalyst activity profiles. In order to adjust the NOx profile at any cross sectional slice 116, the control system may adjust the fuel and air input controls 104. In order to adjust the $NH_3$ profile at any cross sectional slice 116, the control system can adjust ammonia injection controls arranged, e.g., in an ammonia injection grid 118. In order to adjust the catalyst activity profile at any cross sectional slice 116, the control system may adjust the catalyst sootblowing controls 120. Catalyst sootblowing controls operate catalyst sootblowers that are located in the vicinity of the catalyst beds 122 and whose action controls the removal of soot from the catalyst beds. Each cross sectional slice 116 includes one or more sensors 124 that measure one or more properties indicative of the amount of and the distribution of NOx, $NH_3$, and catalyst activity at that cross sectional slice 116. The data collected by the sensors 124 is useful both for timing control variable 104, 118, and 120 operations and for determining the effectiveness of those operations.

The boiler 100 includes a NOx and $NH_3$ slip removal optimization system 126, which can include a controller 128 that configures one or more (preferably all) of the fuel/air injection, ammonia injection, and catalyst soot blow control interfaces 130 in communication with fuel/air injectors 104, ammonia injection grid 118, and catalyst sootblowers 120, respectively. The control interfaces 130 can include a Distributed Control System, DCS, with additional control logic directed towards the fuel/air injectors 104, ammonia injection grid 118, and catalyst sootblowers 120. The NOx and $NH_3$ slip removal optimization system 126 can adjust one or more (preferably all) of the fuel/air injection, $NH_3$ injection, and catalyst sootblowing operating parameters according to desired boiler performance goals using the controller 128. In the illustrated embodiment, controller 128 is a direct controller (i.e., one that does not use a system model). As discussed below, in various embodiments, NOx and $NH_3$ slip removal optimization system 126 may include either a direct controller or an indirect controller (i.e., one that uses a system model). In embodiments in which the optimization system 126 incorporates a direct controller such as controller 128, it can execute and optionally adapt (if it is adaptive) a control law that drives boiler 100 toward the boiler performance goals. Direct control schemes in various embodiments of the invention can include, e.g., a table or database lookup of control variable settings as a function of the process state, and also include a variety of other systems, involving multiple algorithms, architectures, and adaptation methodologies. In one or more embodiments, the direct controller is implemented in a single phase.

In one or more embodiments, controller 128 can be a steady state or dynamic controller. A physical plant, such as boiler 100, is a dynamic system, namely, it is composed of materials that have response times due to applied mechanical, chemical, and other forces. Changes made to control variables or to the state of boiler 100 are, therefore, usually accompanied by oscillations or other movements that reflect the fast time-dependent nature and coupling of the variables. During steady state operation or control, the boiler 100 reaches an equilibrium state such that a certain set or sets of control variable settings enable maintenance of a fixed and stable plant output of a variable such as megawatt power production. Typically, however, boiler 100 operates and is controlled in a dynamic mode. During dynamic operation or control, the boiler 100 is driven to achieve an output that differs from its current value. In certain embodiments, the controller 128 is a dynamic controller. In general, dynamic controllers include information about the trajectory nature of the plant states and variables. In some embodiments, controller 128 can also be a steady-state controller used to control a dynamic operation, in which case the dynamic aspects of the plant are ignored in the control and there is a certain lag time expected for the plant to settle to steady state after the initial process control movements.

In accordance with one or more embodiments of the invention, three general classes of modeling methods can be used for the construction of direct controller 128. One method is a strictly deductive, or predefined, method. A strictly deductive method uses a deductive architecture and a deductive parameter set. Examples of deductive architectures that use deductive parameter sets include parametric models with preset parameters such as first principle or other system of equations. Other strictly deductive methods can include preset control logic such as if-then-else statements, decision trees, or lookup tables whose logic, structure, and values do not change over time.

Controller 128 is preferably adaptive, to capture the off-design or time-varying nature of boiler 100. A parametric adaptive modeling method can also be used in various embodiments of the invention. In parametric adaptive modeling methods, the architecture of the model or controller is deductive and the parameters are adaptive, i.e., are capable of changing over time in order to suit the particular needs of the control system. Examples of parametric adaptive modeling methods that can be used in some embodiments of the invention include regressions and neural networks. Neural networks are contemplated to be particularly advantageous for use in complex nonlinear plants, such as boiler 100. Many varieties of neural networks, incorporating a variety of methods of adaptation, can be used in embodiments of the present invention.

Another type of modeling method, strictly non-parametric, that can also be used in one or more embodiments of the invention uses an adaptive architecture and adaptive parameters. A strictly non-parametric method has no predefined architecture or sets of parameters or parameter values. One form of strictly non-parametric modeling suitable for use in one or more embodiments of the invention is evolutionary (or genetic) programming. Evolutionary programming involves the use of genetic algorithms to adapt both the model architecture and its parameters. Evolutionary programming uses random, but successful, combinations of any set of mathematical or logical operations to describe the control laws of a process.

In embodiments in which controller 128 is adaptive, it is preferably implemented on-line, or in a fully automated fashion that does not require human intervention. The particular adaptation methods that are applied are, in part, dependent upon the architecture and types of parameters of the controller 128. The adaptation methods used in one or more embodiments of the invention can incorporate a variety of types of cost functions, including supervised cost functions, unsupervised cost function and reinforcement based cost functions. Supervised cost functions include explicit boiler output data in the cost function, resulting in a model that maps any set of boiler input and control variables to the corresponding boiler output. Unsupervised cost functions require that no plant output data be used within the cost function. Unsupervised adaptation is primarily for cluster or distribution analysis.

In one or more embodiments of the invention, a direct controller may be constructed and subsequently adapted using a reinforcement generator, which executes the logic from which the controller is constructed. Reinforcement adaptation does not utilize the same set of performance target variable data of supervised cost functions, but uses a highly restricted set of target variable data, such as ranges of what is desirable or what is bad for the performance of the boiler 100. Reinforcement adaptation involves training the controller on acceptable and unacceptable boiler operating conditions and boiler outputs. Reinforcement adaptation therefore enables controller 128 to map specific plant input data to satisfaction of specific goals for the operation of the boiler 100.

One or more embodiments of the invention can use a variety of search rules that decide which of a large number of possible permutations should be calculated and compared to see if they result in an improved cost function output during training or adaptation of the model. In one or more embodiments, the search rule used may be a zero-order, first-order or second-order rule, including combinations thereof. It is preferred that the search rule be computationally efficient for the type of model being used and result in global optimization of the cost function, as opposed to mere local optimization. A zero-order search algorithm does not use derivative information and may be preferred when the search space is relatively small. One example of a zero-order search algorithm useful in embodiments of the invention is a genetic algorithm that applies genetic operators such as mutation and crossover to evolve best solutions from a population of available solutions. After each generation of genetic operator, the cost function may be reevaluated and the system investigated to determine whether optimization criteria have been met. While the genetic algorithms may be used as search rules to adapt any type of model parameters, they are typically used in evolutionary programming for non-parametric modeling.

A first-order search uses first-order model derivative information to move model parameter values in a concerted fashion towards the extrema by simply moving along the gradient or steepest portion of the cost function surface. First-order search algorithms are prone to rapid convergence towards local extrema, and it is generally preferable to combine a first-order algorithm with other search methods to provide a measure of global certainty. In some embodiments of the invention, first-order searching is used in neural network implementation. A second-order search algorithm utilizes zero, first, and second-order derivative information.

In one or more embodiments of the invention, controller 128 is generated in accordance with the control variables available for manipulation and the types of boiler performance objectives defined for boiler 100. Control variables can be directly manipulated in order to achieve the control objectives, e.g., reduce $NO_x$ output. As discussed above, in certain embodiments, the SCR operating parameters are control variables that controller 128 manages directly in accordance with the overall boiler objectives. Significant performance parameters may include, e.g., emissions ($NO_x$), heat rate, opacity, and capacity. The heat rate or NOx output may be the primary performance factor that the SCR optimization system 126 is designed to regulate. Desired objectives for the performance parameters may be entered into the controller 128, such as by an operator, or may be built into the controller 128. The desired objectives may include specific values, e.g., for emissions, or more general objectives, e.g., generally minimizing a particular performance parameter or maintaining a particular range for a parameter. Selecting values or general objectives for performance parameters may be significantly easier initially than determining the corresponding SCR operating settings for attaining those performance values. Desired values or objectives for performance parameters are generally known beforehand, and may be dictated by external requirements. For example, for the heat rate, a specific maximum acceptable level may be provided to controller 128, or controller 128 may be instructed to minimize the heat rate.

In one or more embodiments, controller 128 is formed of a neural network, using a reinforcement generator to initially learn and subsequently adapt to the changing relationships between the control variables, in particular, the SCR operating parameters, and the acceptable and unacceptable overall objectives for the boiler. The rules incorporated in the reinforcement generator may be defined by a human expert, for example. The reinforcement generator identifies the boiler conditions as favorable or unfavorable according to prespecified rules, which include data values such as NOx emission thresholds, stack opacity thresholds, CO emission thresholds, current plant load, etc. For example, the reinforcement generator identifies a set of sootblowing operating parameters as part of a vector that contains the favorable-unfavorable plant objective data, for a single point in time. This vector is provided by the reinforcement generator to controller 128 to be used as training data for the neural network. The training teaches the neural network to identify the relationship between any combination of SCR operating parameters and corresponding favorable or unfavorable boiler conditions. In a preferred embodiment, controller 128 further includes an algorithm to identify the preferred values of SCR operating parameters, given the current values of SCR operating parameters, as well as a corresponding control sequence. In certain contemplated embodiments, the algorithm involves identifying the closest favorable boiler operating region to the current region and determining the specific adjustments to the SCR operating parameters that are required to move boiler 128 to that operating region. Multiple step-wise SCR operating parameter adjustments may be required to attain the closest favorable boiler objective region due to rules regarding SCR operating parameter allowable step-size or other constraints.

Figure 2A:
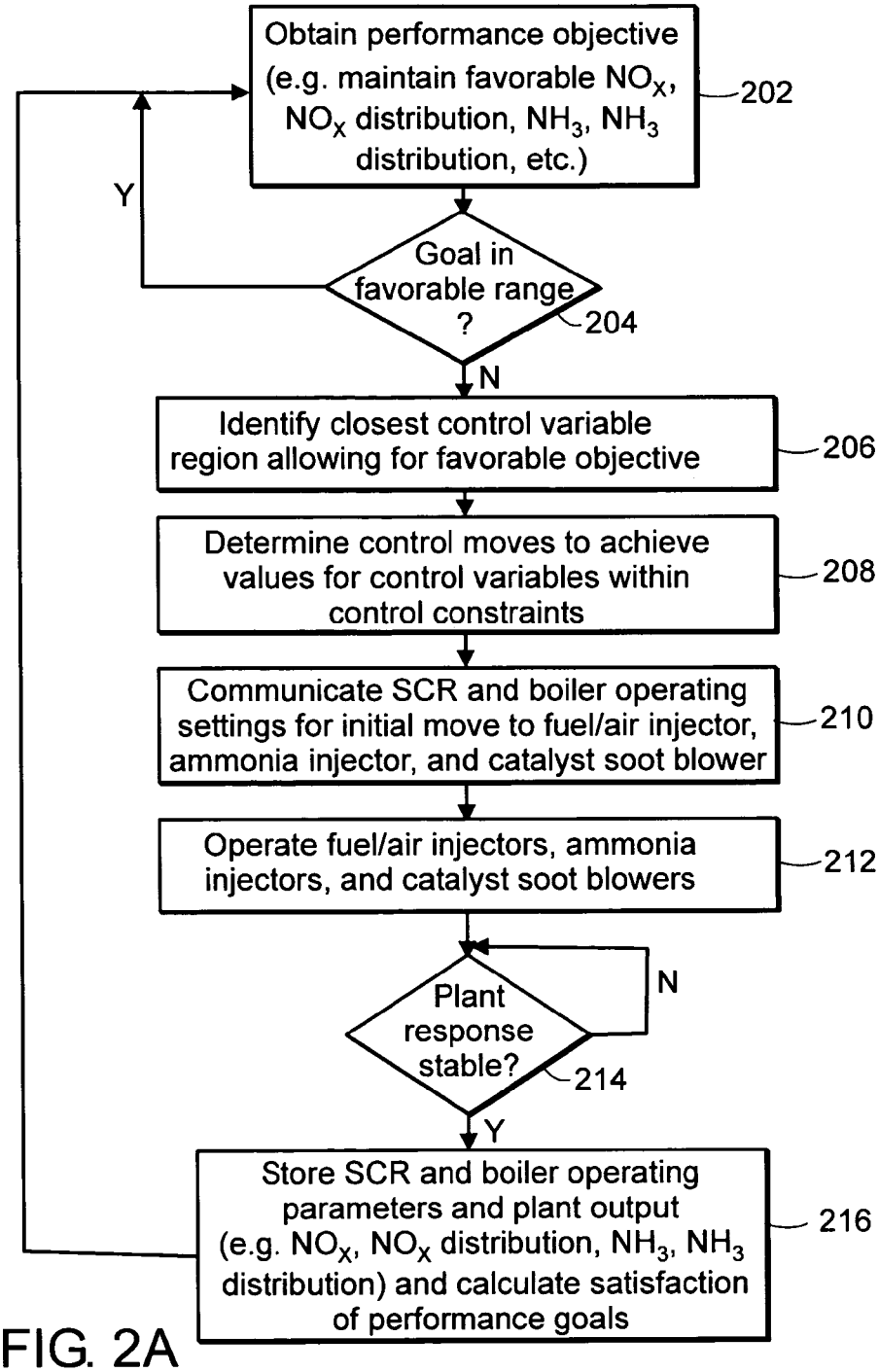
FIGS. 2A and 2B are flow charts illustrating a method for controlling SCR performance in a fossil fuel boiler in accordance with one or more embodiments of the present invention.
Figure 2B:
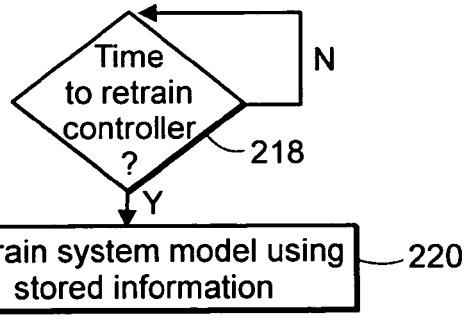

In accordance with one or more embodiments, an exemplary method for controlling SCRs 104 and boiler fuel and air injection systems using controller 128 is shown in FIGS. 2A and 2B. In step 202, controller 128 obtains a performance goal. For example, the goal may be to prioritize maintaining the NOx or $NH_3$ output of boiler 100 in a favorable range or to prioritize maintaining a generally minimal NOx or $NH_3$ variability across a particular cross sectional slice of the boiler. This may be, e.g., a cross sectional slice immediately following the last SCR catalyst bed or a cross sectional slice within the boiler stack, immediately preceding emission of boiler effluent out of the stack. The selection of performance goal obtained in step 202 may also be influenced by the nature of the controller and control logic 130. In particular, controller 130 may contain a DCS that contains both feed forward and feedback controls for $NH_3$ injection amount. If the feedback loop is to maintain a certain fixed stack NOx amount, then the controller 128 will not be able to effectively use a performance goal of stack NOx minimization. Under these conditions, the performance goal selection could be to minimize NOx cross sectional slice variability or to minimize $NH_3$ slip or $NH_3$ output variability or to minimize the cross sectional variability of the boiler NOx profile and the $NH_3$ injection profile, etc. In step 204, controller 128 checks the present NOx output or other present measured or calculated objective. If the objective is already favorable, controller 128 maintains the present control state or executes a control step from a previously determined control sequence until a new goal is received or the plant output is checked again. If the objective is not favorable, then in step 206, controller 128 identifies the closest control variable region allowing for favorable objective. In one or more embodiments, the closest favorable boiler objective region is identified by an analysis of the boiler objective surface of the neural network of controller 128. The boiler objective surface is a function, in part, of the current boiler operating conditions. In certain embodiments, the algorithm sweeps out a circle of radius, r, about the point of current SCR and boiler operating settings. The radius may be calculated as the square root of the quantity that is the sum of the squares of the distance between the current setting of each SCR parameter value and the setting of the proposed SCR parameter value. In particular, $$\text{Radius}^2=\Sigma_i^N\alpha_i(S.P^2_{i\text{-}proposed}-S.P^2_{i\text{-}current})^2$$

for each $i^{th}$ SCR parameter, up to SCR parameter number N, with normalization coefficients $\alpha_i$. The sweep looks to identify a point on the boiler objective surface with a favorable value. If one is found in the first sweep, the radius is reduced, and the sweep repeated until the shortest distance (smallest radius) point has been identified. If a favorable plant objective surface point is not found upon the first sweep of radius r, then the radius is increased, and the sweep repeated until the shortest distance (radius) point has been identified. In a one or more embodiments, multiple SCR and boiler parameters may need to be adjusted simultaneously at the closest favorable control region. By way of example, the SCR parameter values can include unit load and furnace temperature, vertical and horizontal fuel and air distribution settings that directly impact total furnace NOx and furnace NOx distributions; total $NH_3$ injection settings; $NH_3$ left/right and front/back bias settings; SCR inlet gas temperature; catalyst cleanliness and catalyst activity distributions, etc. In addition to identifying the closest control variable region that allows for satisfying the performance goal, controller 128 also determines a sequence of control moves in step 208. A number of control moves may be required because controller 128 may be subject to constraints on how many parameters can be changed at once, how quickly they can be changed, and how they can be changed in coordination with other parameters that are also adjusted simultaneously, for example. Other constraints may exist that limit the objective value of the performance goal, rather than limiting the rate at which controls may be moved to achieve the desired objective. For instance, if the performance goal is to minimize stack NOx, a constraint to limit the $NH_3$ slip should be built. This constraint would limit the amount and distribution of $NH_3$ injection and or NOx distribution so that the lowest stack NOx objective would be targeted that would be consistent with the specified $NH_3$ slip constraint. Controller 128 determines an initial control move. In step 210, it communicates that control move to the SCR and boiler manipulatable controls, for example, through control interface 130. In step 212, fuel/air injection 104, ammonia injection 118, and catalyst sootblowers 120 operate in accordance with the desired operating settings. After a suitable interval, indicated in step 214, preferably when the response to the fuel/air injection, ammonia injection, and catalyst sootblowing operations are stable, the operating parameters and boiler outputs, i.e., indicators of actual boiler performance, are stored in step 216. Additionally, satisfaction of the performance goal is also measured and stored. In particular, the system may store information about whether the NOx level is satisfactory or has shown improvement. The control sequence is then repeated. In some embodiments, the identified SCR and boiler operating settings may not be reached because the performance goal or boiler operating conditions may change before the sequence of control moves selected by the controller for the previous performance goal can be implemented, initiating a new sequence of control moves for the SCR and boiler operation.

As shown in FIG. 2B at steps 218 and 220, the stored SCR and boiler operating setting and boiler outputs, and the reinforcement generator's assessment of favorable and unfavorable conditions, are used on a periodic and settable basis, or as needed, as input to retrain controller 128. Regular retraining of controller 128 allows it to adjust to the changing relationship between the SCR and boiler parameters and the resulting boiler output values. In some embodiments of the invention, in place of controller 128 and interface 130, only a single controller is used to select the SCR and boiler operating parameters and also operate the fuel/air injection 104, ammonia injection 118, and catalyst sootblowing 120 according to those settings.

Figure 3:
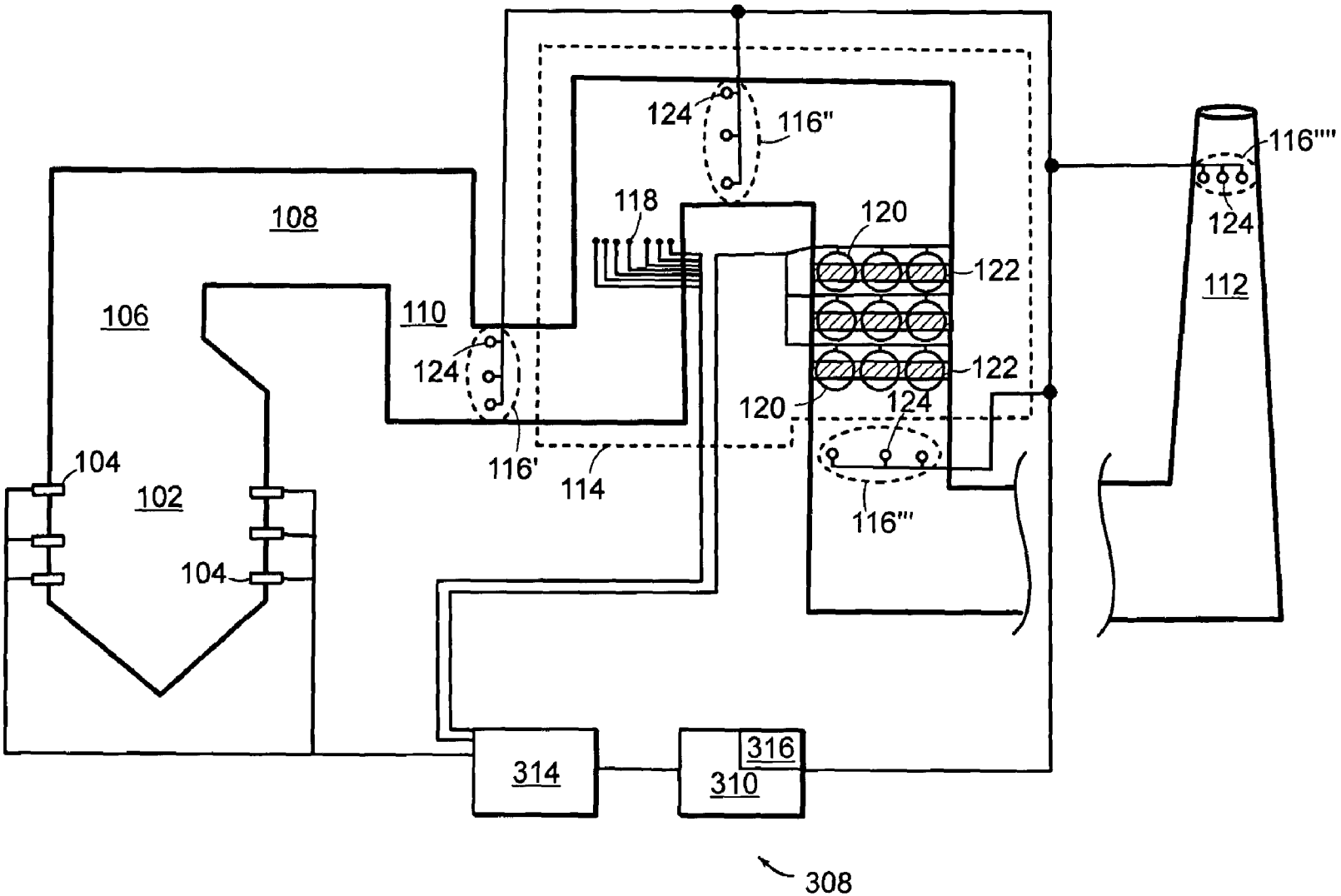
FIG. 3 is a schematic diagram of a fossil fuel boiler with an SCR optimization system in accordance with one or more embodiments of the invention.

As illustrated in FIG. 3, one or more embodiments of the present invention may incorporate an alternative NOx and $NH_3$ slip optimization system 308. The NOx and $NH_3$ slip optimization system 308 includes a controller 310. In the illustrated embodiment, controller 310 is an indirect controller that uses a system model 316 to determine the catalyst sootblower, fuel and air injection, and NH3 injection operating parameters that are required to achieve a desired performance level of boiler 100. Similar to the controller 128, the controller 310 can optimize some or all of the catalyst sootblowing, fuel and air injection, and $NH_3$ injection parameters to achieve and maintain the desired performance. In NOx and $NH_3$ slip optimization system 308, controller 310 can also communicate with the SCR sootblower, fuel and air, and $NH_3$ injection operating settings to the catalyst sootblower, fuel and air, and $NH_3$ injection control interfaces 314. System model 316 is an internal representation of the plant response resulting from changes in its control variables with catalyst sootblower, fuel and air, and $NH_3$ injection operating parameters among the inputs, in addition to various control variables. In such embodiments, controller 310 learns to control the injection and cleaning processes by first identifying and constructing system model 316 and then defining control algorithms based upon the system model 316.

In accordance with one or more embodiments, the system model 316 can represent a committee of models. In one or more embodiments of the invention incorporating an indirect controller, controller 310 may use any number of model architectures and adaptation methods. Various implementation techniques previously described in conjunction with controller 128 are also applicable to model 316. In general, model 316 predicts the performance of the boiler under different combinations of the control variables.

In one or more embodiments, system model 316 is a neural network, mass-energy balance model, genetic programming model, or other system model. Models can be developed using data about the actual performance of the boiler 300. For example, a neural network or genetic programming model can be trained using historical data about the operation of the boiler. A mass-energy balance model can be computed by applying first principles to historical or real-time data to generate equations that relate the performance of boiler 300 to the state of boiler 300 and the SCR sootblower, fuel and air, and NH3 injection operating parameters. Data that is collected during subsequent operation of the boiler 300 can later be used to re-tune system model 316 when desired.

Figure 4A:
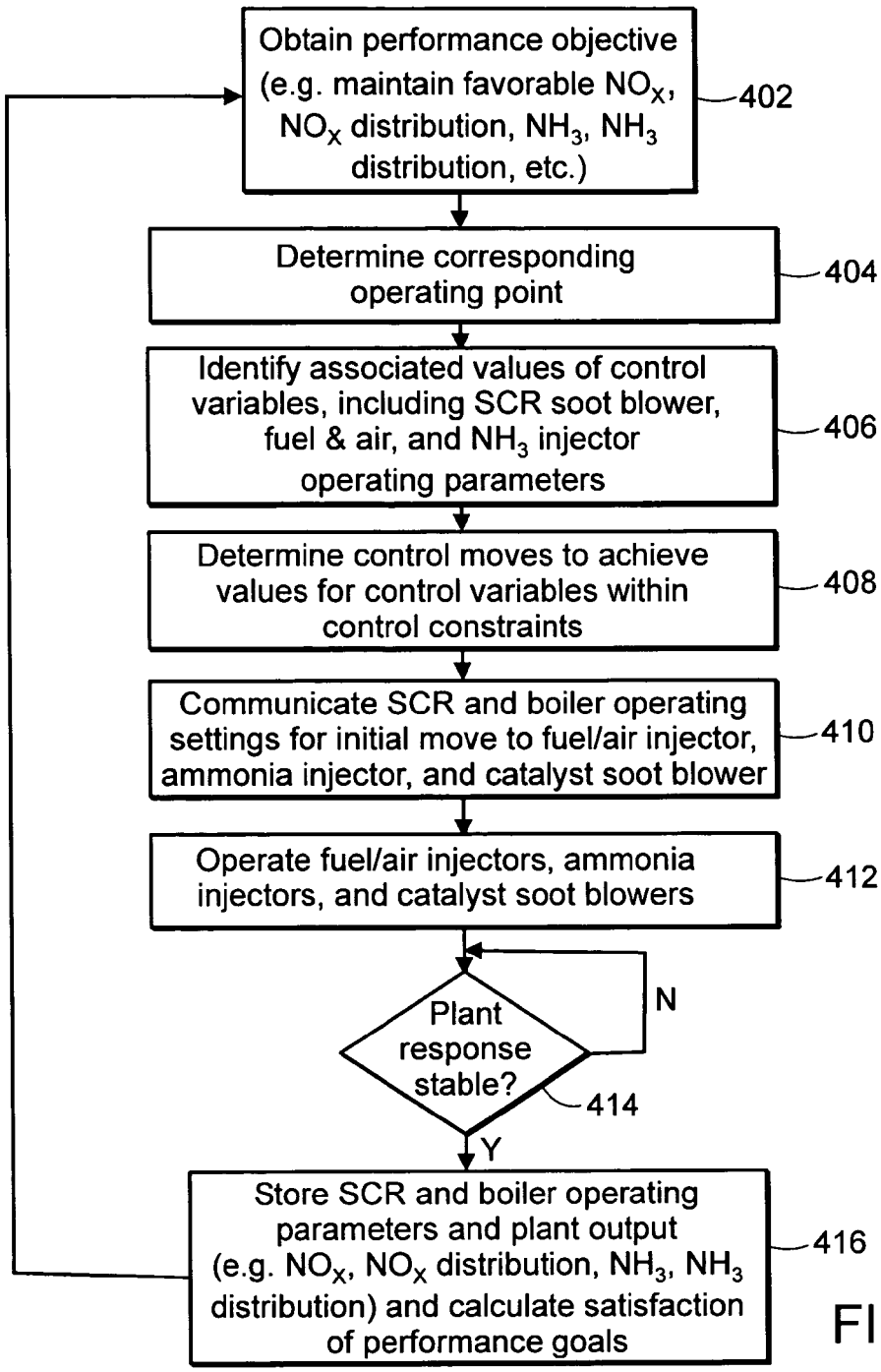
FIGS. 4A and 4B are flow charts illustrating a method for controlling SCR performance in a fossil fuel boiler in accordance with one or more embodiments of the present invention.
Figure 4B:
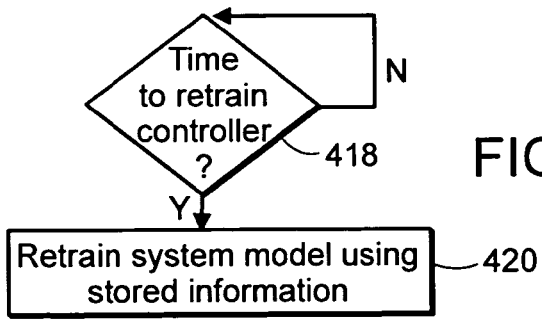

FIGS. 4A and 4B are flow diagrams showing steps of a method for controlling SCRs and boiler fuel and air injection systems in accordance with one or more embodiments of the invention using an indirect controller such as controller 310. In step 402, controller 310 receives a performance goal. In step 404, in accordance with one or more embodiments, controller 310 uses system model 316 to identify a point on the model surface corresponding to the current boiler state that meets the current boiler performance goal, e.g., minimizing NOx. In step 406, controller 310 uses system model 316 to determine the boiler inputs, such as the SCR sootblower, fuel and air, and $NH_3$ injection operating parameters, corresponding to that point that will generate the desired boiler outputs. In step 408, controller 310 determines control moves to achieve values for control variables within control constraints as with controller 128. In step 410, controller 310 communicates the SCR sootblower, fuel and air, and $NH_3$ injection operating settings for the initial step to SCR sootblower, fuel and air, and $NH_3$ injection control interfaces 314. In step 412, sootblowers, fuel and air injectors, and $NH_3$ injectors are operated in accordance with the SCR sootblower, fuel and air, and $NH_3$ injection operating settings.

After a suitable interval, preferably after the plant response is determined to be stable at 414, the SCR sootblower, fuel and air, and NH3 injection operating parameters and plant outputs, such as the NOx output, are stored at 416. The control cycle is repeated after suitable intervals.

As shown in FIG. 4B, at step 418, from time to time, controller 314 and/or model 316 are determined to require retraining, e.g., on a periodic basis or as needed. Accordingly, system model 316 is retrained using the information stored in step 420.

Figure 5:
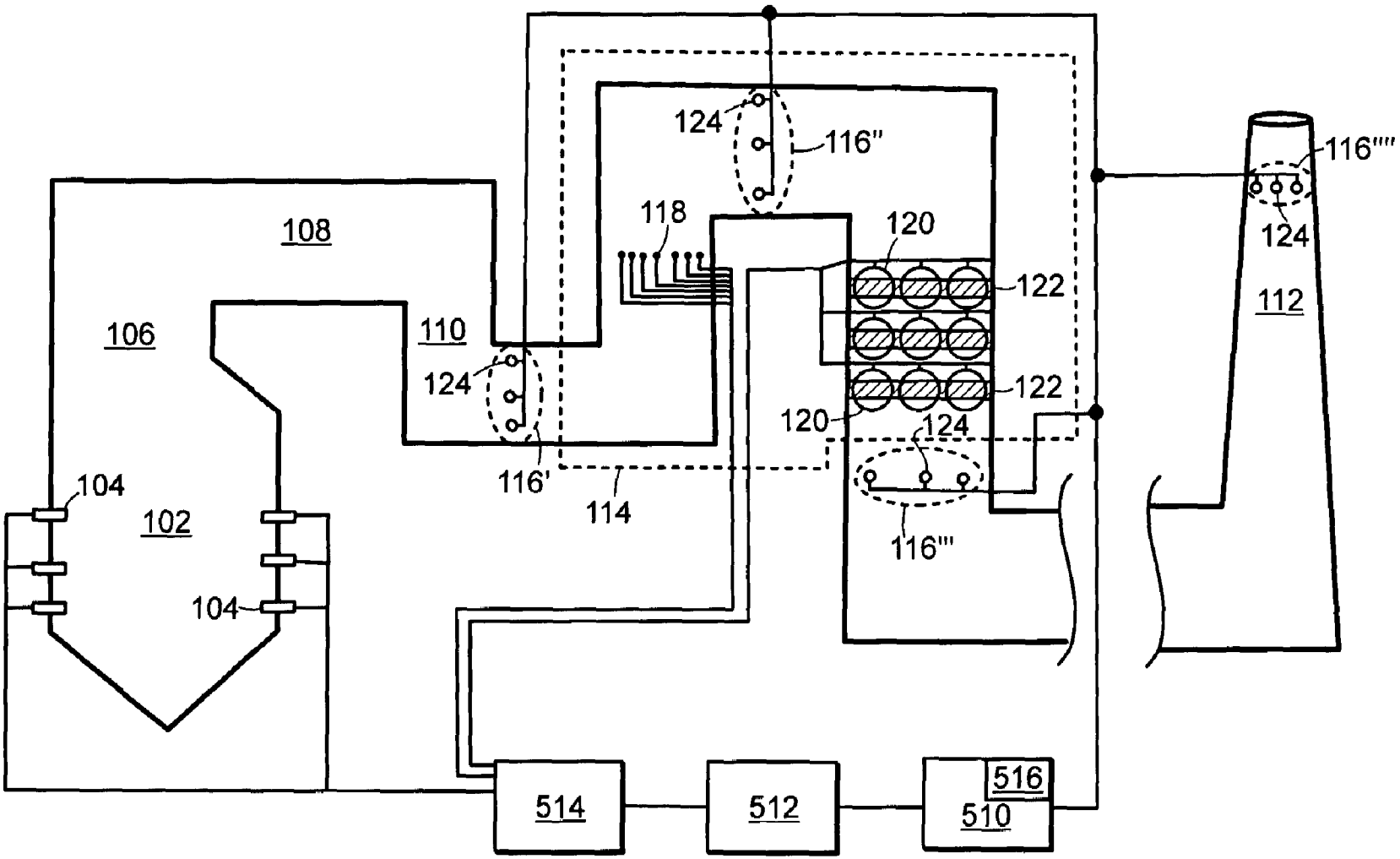
FIG. 5 is a schematic diagram of a fossil fuel boiler with a SCR optimization system in accordance with one or more embodiments of the invention.

In one or more alternate embodiments, shown, e.g., in FIG. 5, an optimization system 508 includes a the controller 510 that is an indirect controller and uses a system model 516 to determine a set of NOx profiles, $NH_3$ profiles, and catalyst activity profiles for the set of cross sectional slices 116 in the boiler that are used to achieve or approximate as closely as possible a desired performance level of the boiler. In one or more alternate embodiments, controller 510 can be a direct controller that determines the set of NOx, $NH_3$, and catalyst activity profiles. In either type of embodiment, NOx, $NH_3$, and catalyst activity profiles are determined as functions of the boiler performance goals, which are generally known or readily definable. In one embodiment, controller 510 uses system model 516 to evaluate the effects of different sets of catalyst activity, NOx, and $NH_3$ profiles under the current boiler operating conditions and determine one or more sets of catalyst activity, NOx, and $NH_3$ profiles that will satisfy the desired performance objective. Controller 510 receives as input the current boiler state, including the current catalyst activity, NOx, and $NH_3$ profiles, and desired performance goals. As discussed above, boiler operating conditions generally include fuel/air mixtures, feed rates, the type of fuel used, $NH_3$ injection distribution, $NH_3$ total injection, catalyst sootblowing activity, etc. As illustrated in FIG. 5, the controller 510 is in communication with a processor 512 that optimizes one or more of the catalyst sootblower, $NH_3$ injection, and fuel and air injection operating parameters to maintain given catalyst activity, $NH_3$, and NOx profiles. Controller 510 transmits sets of catalyst activity, $NH_3$, and NOx profiles to processor 512. Processor 512 optimizes the catalyst sootblower, $NH_3$ injection, and fuel and air injection operating parameters to maintain the received profiles. Processor 512 in turn is in communication with a catalyst sootblower, $NH_3$ injector, and fuel and air injector control interfaces 514 and transmits the desired catalyst sootblower, $NH_3$ injection, and fuel and air injection operating parameters to the control interfaces 514 as necessary.

As illustrated, a single controller 128, 310, or 510 or processor 512 can handle control of all of the cross sectional slices 116 in the boiler. Alternatively, multiple controllers or processors may be provided to handle the cross sectional slices 116 in the boiler.

In another embodiment of the invention, processor 512 is an indirect controller that incorporates a system model that relates the catalyst sootblower, $NH_3$ injector, and fuel and air injector operating parameters to the catalyst activity, NOx, and $NH_3$ profiles in cross sectional slices 116. Processor 512 can use a process similar to the process shown in FIG. 4 to determine a set of catalyst sootblower, NH3 injector, and fuel and air injector operating settings from a received set of desired catalyst activity, NOx, and $NH_3$ profiles using a system model. Processor 512 receives as inputs the current boiler operating conditions, including the current catalyst activity, NOx, and $NH_3$ profiles measured by sensors 106, as well as the set of desired catalyst activity, NOx, and $NH_3$ profiles. The set of desired profiles provide the performance goal for the processor 512. Using the system model, processor 512 identifies the corresponding operating point and then selects one or more control moves to attain the desired operating point. The system model incorporated in processor 512 can be retrained periodically or as needed. The system model can also be represented as a committee of models.

In one or more embodiments of the invention a single controller, as, e.g., described previously as controller 510, may be integrated with processor 512 and control interface 514. In this integrated embodiment, the controller may compute both desired catalyst activity, NOx, and $NH_3$ profiles and catalyst sootblower, $NH_3$ injection, and fuel and air injection operating parameters expected to attain those catalyst activity, NOx, and NH3 profiles. In another embodiment of the invention, a single indirect controller may result from the integration of the function of processor 512 and control interface 514. In this integrated embodiment, the indirect controller will compute and control the catalyst sootblower, NH3 injection, and fuel and air injection parameters necessary to attain the desired catalyst activity, NOx, and $NH_3$ profiles specified by the output of controller 510.

Controllers 128, 310, 510 in the illustrated embodiments of the invention, are preferably implemented in software and run their respective models also, preferably software to perform the computations described herein, and are operable on a computer. The particular software used is not a critical feature of the invention and one of ordinary skill in the art will be able to write various programs to perform the functions described herein. The computer may include, e.g., data storage capacity, output devices, such as data ports, printers and monitors, and input devices, such as keyboards, and data ports. The computer may also include access to a database of historical information about the operation of the boiler. Processor 112 is a similar computer designed to perform the processor computations described herein.

As indicated above, various components of the SCR optimization system could be integrated. For example, the catalyst sootblower, $NH_3$ injector, and fuel and air injector control interfaces 514, the processor 512, and the model-based controller 510 could be integrated into a single computer; alternatively model-based controller 310 and catalyst sootblower, $NH_3$ injector, and fuel and air injector interfaces 314 could be integrated into a single computer. The controllers 128, 310 or 510 may include an override or switching mechanism so that efficiency set points or catalyst sootblower, $NH_3$ injector, or fuel and air injector optimization parameters can be set directly, e.g., by an operator, rather than by the model-based controller when desired.

While the present invention has been illustrated and described with reference to preferred embodiments thereof, it will be apparent to those skilled in the art that modifications can be made and the invention can be practiced in other environments without departing from the spirit and scope of the invention.

The invention claimed is:

1. A system for controlling performance of a selective catalytic reduction (SCR) system for reducing NOx levels in flue gas associated with a fossil fuel boiler having one or more generally cross-sectional areas, each cross-sectional area being characterized by a profile of a condition affecting SCR performance at said cross-sectional area, the system comprising:

one or more devices associated with said one or more cross-sectional areas for adjusting the profile characterizing a cross-sectional area, said one or more devices operating in accordance with adjustable operating parameters;

one or more sensors associated with said one or more cross-sectional areas for detecting conditions at said one or more cross-sectional areas; and a computer programmed to operate as an indirect controller for determining operating settings for the one or more devices, said indirect controller including:

a system model that relates operating settings for the one or more devices to desired profiles of said conditions affecting SCR performance at said one or more generally cross-sectional areas, a controller input in communication with said one or more sensors, said indirect controller using the conditions detected by said one or more sensors, the system model, and the desired profiles to determine operating settings for the one or more devices, and a controller output in communication with said one or more devices to transmit said operating settings to said one or more devices associated with said one or more generally cross-sectional areas of the fossil fuel boiler;

wherein said one or more devices include an SCR sootblower associated with at least one of said one or more cross-sectional areas for cleaning a surface in a catalyst bed to adjust a catalyst activity profile, an $NH_3$ injector associated with at least one of said one or more cross-sectional areas to inject $NH_3$ in said boiler and to adjust a $NH_3$ profile, and a fuel and air injector associated with at least one of said one or more cross-sectional areas to inject fuel and air in said boiler and adjust a NOx profile;

wherein said one or more sensors associated with at least one of said one or more cross-sectional areas detect a NOx level, an $NH_3$ level, and catalyst activity at said one or more cross-sectional areas;

wherein said indirect controller includes a system model that relates operating settings for the SCR sootblower to a desired catalyst activity profile, operating settings for the $NH_3$ injector to a desired $NH_3$ profile, and operating settings for the fuel and air injector to a desired NOx profile;

wherein the indirect controller uses the NOx levels, the $NH_3$ levels and the catalyst activity detected by said one or more sensors, the system model, and the desired catalyst activity profile, the desired $NH_3$ profile, and the desired NOx profile to determine operating settings for the SCR sootblower, the $NH_3$ injector, and the fuel and air injector, respectively; and wherein the controller output of the indirect controller communicates with said SCR sootblower, $NH_3$ injector, and air and fuel injector to transmit said SCR sootblower operating settings to said SCR sootblower, said $NH_3$ injector operating settings to said $NH_3$ injectors, and said fuel and air operating settings to said fuel and air injectors.

2. A system according to claim 1, wherein said boiler has a plurality of said generally cross-sectional areas.

3. A system according to claim 1, wherein said one or more generally cross-sectional areas of the boiler include at least one cross-sectional area external to the SCR system.

4. A system according to claim 1, wherein said one or more generally cross-sectional areas of the boiler include at least one cross-sectional area upstream of an SCR catalyst.

* * * * *